US010737524B2

(12) United States Patent
Nakamura

(10) Patent No.: US 10,737,524 B2
(45) Date of Patent: Aug. 11, 2020

(54) BINDING METHOD OF PERFECT-BOUND BOOKLET

(71) Applicant: NAKAMURA PRINTING & BINDING CO., LTD., Kita-Ku, Tokyo (JP)

(72) Inventor: Teruo Nakamura, Tokyo (JP)

(73) Assignee: Nakamura Printing & Binding Co., Ltd., Tokyo (JP)

( * ) Notice: Subject to any disclaimer, the term of this patent is extended or adjusted under 35 U.S.C. 154(b) by 0 days.

(21) Appl. No.: 16/340,821

(22) PCT Filed: Nov. 17, 2017

(86) PCT No.: PCT/JP2017/037554
§ 371 (c)(1),
(2) Date: Apr. 10, 2019

(87) PCT Pub. No.: WO2019/077678
PCT Pub. Date: Apr. 25, 2019

(65) Prior Publication Data

US 2020/0114676 A1 Apr. 16, 2020

(51) Int. Cl.
*B42C 9/00* (2006.01)
*B42C 3/00* (2006.01)
*B42C 19/02* (2006.01)

(52) U.S. Cl.
CPC ..... *B42C 3/00* (2013.01); *B42C 9/00* (2013.01); *B42C 9/0006* (2013.01); *B42C 19/02* (2013.01)

(58) Field of Classification Search
CPC ..... B42C 9/00; B42C 9/0006
See application file for complete search history.

(56) References Cited

U.S. PATENT DOCUMENTS 3,423,107 A * 1/1969 Chamberlain ..... B42C 9/0006 281/21.1
4,184,218 A 1/1980 Hawkes
4,496,617 A * 1/1985 Parker ..... B42D 1/10 156/908

(Continued)

FOREIGN PATENT DOCUMENTS

JP S48-36911 U 5/1973
JP S59-207293 A 11/1984

(Continued)

*Primary Examiner* — Kyle R Grabowski
(74) *Attorney, Agent, or Firm* — Carrier Blackman & Associates, P.C.; Joseph P. Carrier; Anne G. Sabourin

(57) ABSTRACT

A binding method of a perfect-bound booklet includes the steps of folding each leaf of sheets forming a body to obtain multiple signatures; pressing creased parts of the multiple signatures in a thickness direction thereof; jogging a one-book bundle formed of a predetermined number of signatures forming a body, a front cover, and a back cover, or a multi-book bundle formed by stacking a plurality of one-book bundles on top of one another; applying a first adhesive that remains flexible upon curing, in a layer in a middle area 5 to 10 millimeters from both top and bottom ends of a rear face of the one-book bundle or the multi-book bundle; applying a second adhesive on the entire rear face; and drying and curing the second adhesive for a predetermined drying time.

14 Claims, 7 Drawing Sheets

(56) References Cited

U.S. PATENT DOCUMENTS

| | | | | | |
|---|---|---|---|---|---|
| 4,728,688 | A * | 3/1988 | Tizzard | B42C 9/00 | 524/504 |
| 4,960,295 | A * | 10/1990 | Bodouroglou | B42C 9/0006 | 281/15.1 |
| 5,156,510 | A * | 10/1992 | Uehara | B42D 3/002 | 156/325 |
| 5,672,030 | A * | 9/1997 | Dean | B42C 9/0006 | 281/21.1 |
| 9,616,698 | B2 | 4/2017 | Noguchi et al. | | |
| 2003/0012622 | A1* | 1/2003 | Itoh | B42C 9/0037 | 412/37 |
| 2017/0203599 | A1* | 7/2017 | Griffith | B42D 5/00 | |

FOREIGN PATENT DOCUMENTS

| | | | |
|---|---|---|---|
| JP | 2004-188863 | A | 7/2004 |
| JP | 3167600 | U | 5/2011 |
| JP | 2011-126020 | A | 6/2011 |
| JP | 2014-213597 | A | 11/2014 |
| JP | 5743362 | B1 | 7/2015 |

* cited by examiner

BINDING METHOD OF PERFECT-BOUND BOOKLET

TECHNICAL FIELD

The present invention relates to an improved binding technique of a perfect-bound booklet, specifically to a binding method of a perfect-bound booklet having excellent spreadability, and a perfect-bound booklet bound by the binding method.

BACKGROUND ART

A perfect-bound binding method, in which a body is composed of a layered product formed by jogging, stacking, and bundling a predetermined number of sheets, and then applying an adhesive on a rear face of the body, and if needed, in the vicinity of the face to attach a front cover to the body, is also adopted to bind notebooks or other kinds of booklets. As described above, in this binding method, an adhesive is applied on a face of the rear side (rear face) of the body to fix the back of the body. Hence, the booklet can be opened to the right and left from its joint, and the method is known to have advantages such as lower cost than saddle stitching binding, and more freedom in the number of sheets forming the body.

However, in this binding method, a rear end part of each sheet of the body is arranged and fixed perpendicular to the applied adhesive layer. For this reason, when an arbitrary page of the booklet is opened, normally, each sheet having its end fixed substantially perpendicular to the adhesive layer bulges upward particularly in the vicinity of the joint part, and therefore the sheets of the opened right and left pages do not open substantially 180 degrees. Thus, there has been a problem of insufficient spreading.

Additionally, in recent years, in binding of a perfect-bound booklet, a hot-melt type adhesive has been often used to attach the front cover to the rear face of the body. When the adhesive is applied, the low-viscosity adhesive melted by heating flows into the joint part between the body and the flyleaf (front cover), where the front cover and the rear end part of the first sheet in contact with the front cover are bonded. This causes a problem that the first sheet of the body cannot be opened favorably. Moreover, to improve adhesion of the sheets of the body and prevent them from dropping from the booklet, a kerf, a slit or the like substantially parallel to the thickness direction of the body is provided in the rear part of the body, and the sheets are bonded with an adhesive (notched or burst binding). Providing the kerf, slit or the like is effective in improving the adhesiveness of the sheets of the body to the inner face of the back part of the front cover. However, there has also been a problem that the adhesive infiltrates the inside of the body through the kerf to bond rear areas of the joint of adjacent sheets, whereby the pages cannot be spread 180 degrees.

As a result of extensive studies to solve the above problems, the applicant has developed a perfect-bound booklet (see Patent Literature 1) that can be spread favorably with right and left pages opened substantially 180 degrees without the vicinity of the joint part bulging upward when an arbitrary page of the body is opened, and the applicant has placed the product on the market as a flat notebook (registered trademark). The binding method described in Patent Literature 1 is aimed to bind a booklet in which an arbitrary folded signature in the body does not come off and drop from the body, and in a quality check after binding, the bonding strength of the rear glue has been checked thoroughly to see whether a signature does not come off and drop from the body.

However, recently, there have been many user requests for a perfect-bound booklet having contradictory functions of preventing a signature of the body from coming off and dropping in a normal state, but allowing a signature or a leaf to be cut off from the bottom of the joint when necessary, like a block memo pad.

Note that in the specification, "edge" of a booklet refers to a cut end (front edge) parallel to a spine of the booklet. In addition, "bundle" in "one-book bundle" or "multi-book bundle" collectively refers to a body formed of a predetermined number of sheets, a front cover, and a back cover.

CITATION LIST

Patent Literature

Patent Literature 1: Japanese Patent No. 5743362

SUMMARY OF INVENTION

Technical Problem

As a result of extensive studies to meet the users' needs and solve the aforementioned problems, the present inventors have gained the following knowledge and completed the present invention.

(1) In order to neatly cut off an arbitrary leaf in particular from a body formed of signature stacks, creases of the stacks having undergone a paper folding step needs to be pressed even stronger.

(2) It has been found that an arbitrary leaf can be cut off neatly from the body with good repeatability, when an adhesive that remains flexible upon curing is used as a first adhesive firstly fixing multiple signatures.

(3) In order to cut off an arbitrary leaf from any of the top or bottom ends of the body, if the first adhesive described in (2) is used, the leaf tends to be cut off neatly along the crease when the adhesive is not applied in any of the top or bottom end area of the body.

That is, an object of the present invention is to provide a bonding method of a perfect-bound booklet that can create a perfect-bound booklet having excellent spreadability, and in which an arbitrary signature, or one or several leaves of a body can be cut off neatly from the bottom of a joint or along a crease, and any of the remaining signatures or leaves do not come off and drop even after cutting.

Solution to Problem

According to an aspect of the present invention, the object is achieved by a binding method of a perfect-bound booklet including: a paper folding step of folding each leaf of sheets forming a body to obtain multiple signatures; a pressing step of pressing creased parts of the multiple signatures in a thickness direction of the multiple signatures; a paper jogging step of jogging a one-book bundle comprised of a predetermined number of signatures forming a body, a front cover, and a back cover, or a multi-book bundle formed by stacking a plurality of one-book bundles on top of one another; a first application step of applying a first adhesive that remains flexible upon curing, in a layer in a middle area excluding each part of 5 to 10 millimeters width from top end edge and bottom end edge of a rear face of the one-book bundle or the multi-book bundle; and a second application step of applying a second adhesive in a layer on the entire face of the one-book bundle including the parts where the first adhesive is not applied, after leaving the first adhesive layer for a predetermined drying time.

An acrylic resin emulsion adhesive is preferably used as the first adhesive. Although the drying time of the first adhesive may be set appropriately by taking into account the efficiency of work steps and the like, it is preferably set within the range of 0.5 to 2 hours.

A water-based emulsion adhesive containing an ethylene-vinyl acetate copolymer or a vinyl acetate acrylic copolymer as a main component is preferably used as the second adhesive. Although the drying time of the second adhesive may also be set appropriately by taking into account the efficiency of work steps and the like, it is preferably set within the range of 1 to 3 hours.

A cloth bonding step of placing and bonding a cloth on a rear part of a one-book bundle may be performed after the drying of the second adhesive, so that a clothbound booklet can be produced. When the front cover and the back cover are formed integrally as a glued-on cover so as to sandwich a rear part of the body, a wrapping step of wrapping the body may be performed to produce the booklet by case binding.

According to another aspect of the present invention, the object is achieved by a perfect-bound booklet bound by use of the binding method of a perfect-bound booklet, in which, when a body is opened at an arbitrary page, a printing area continuous from a left page to a right page is formed.

Advantageous Effects of Invention

According to the binding method of a perfect-bound booklet of the present invention, the creased part of a one-book bundle is pressed in the thickness direction of the bundle, a first adhesive that remains flexible upon curing is applied to a middle area of a rear face of the bundle, a second adhesive is applied and dried on the entire face of the rear face within a relatively short time, and the rear parts of the three of the body, front cover and back cover are integrally fixed. Hence, the obtained perfect-bound booklet not only has excellent spreadability, but also a leaf of a signature can be cut off neatly from a joint part of the booklet along a crease. Additionally, since the perfect-bound booklet of the present invention has excellent spreadability as mentioned above, a single continuous printing area can be set to extend over arbitrarily opened right and left pages.

DESCRIPTION OF EMBODIMENT

Hereinafter, an embodiment of a binding method of a perfect-bound booklet of the present invention will be described in detail with reference to the accompanying FIGS. 1 to 6. Note, however, that the binding method of a perfect-bound booklet of the present invention is not limited to the following embodiment.

Figure 1:
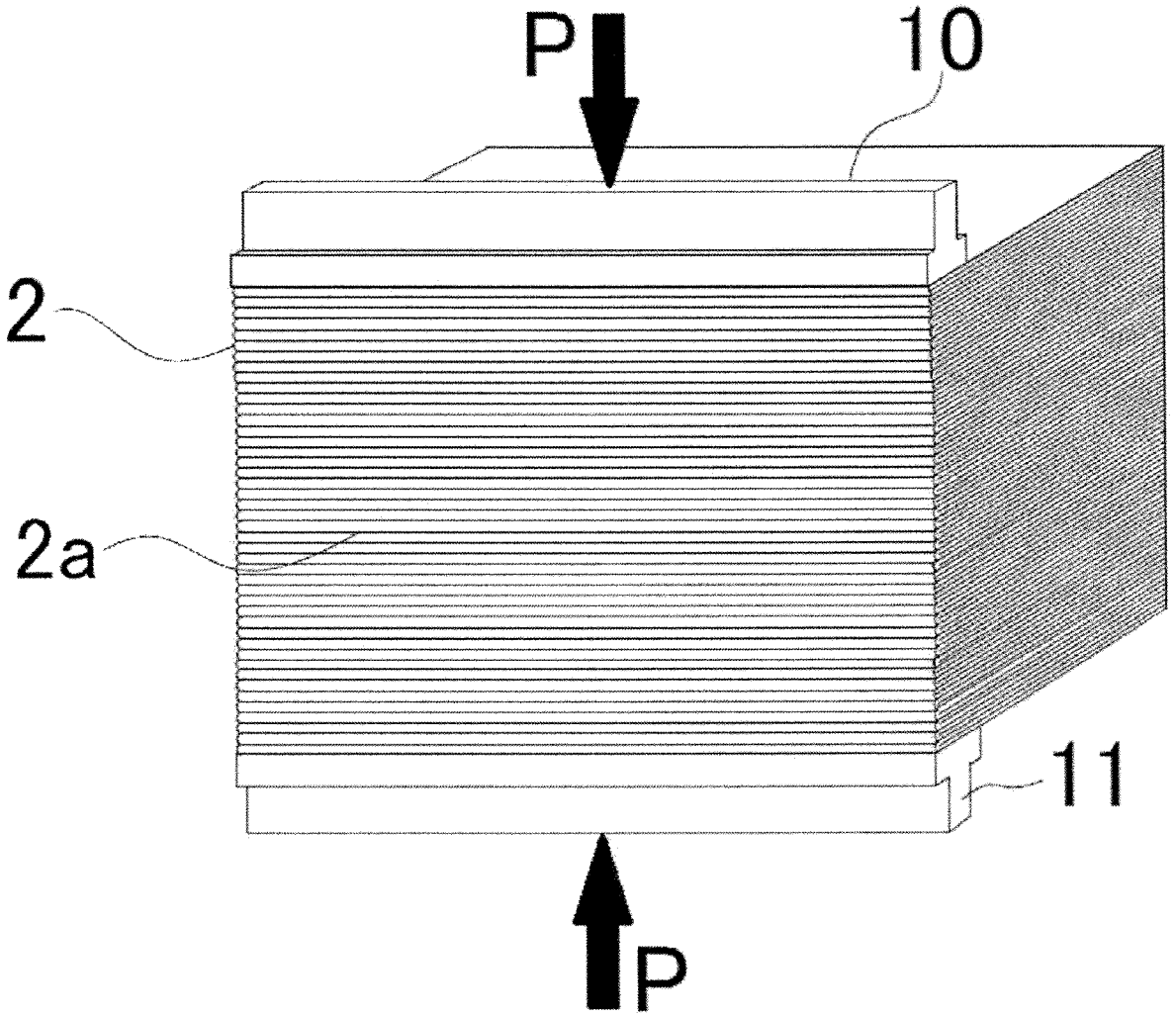
FIG. 1 is a diagram showing an example of a pressing step in a binding method of a perfect-bound booklet of the present invention.

FIG. 1 is a diagram for describing an example of the binding method of a perfect-bound booklet of the present invention. As shown in FIG. 1, the binding method of a perfect-bound booklet of the present invention includes a paper folding step, a pressing step (see part (a) of FIG. 1), a paper jogging step (see parts (b), (c) of FIG. 1), a first adhesive application step (see part (d) of FIG. 1), a second adhesive application step (see part (e) of FIG. 1), and a drying step.

First, a description will be given of a body 2, a front cover 3, and a back display material 4, which are main constituent members of the perfect-bound booklet. The type of sheet forming the body 2 is not particularly limited, and any normally used sheet may be adopted for the body, depending on the type of booklet such as a magazine, a notebook, a pocket book, a pamphlet, a photo book and so on. Specific examples of such sheet include: an uncoated printing paper such as a high quality paper, a medium quality paper, a low quality paper, and a printing tissue paper; an ultra light-weight coat paper; a coated printing paper such as an art paper, a coat paper, and a lightweight coat paper; a special paper such as a colored high quality paper, etc.; and a communication paper such as a manifold paper, a copying paper, etc. These papers may be used alone or in combination. The basis weight of the sheet is not particularly limited either, and a sheet within the range of 40 to 150 g/m2 may be used, for example. If the booklet to be bound is a notebook, for example, a sheet of a basis weight of approximately 70 g/m2 is normally used. The sheet may either be printed or not printed. When a booklet with all pages printed is bound, normally before the paper folding step, printing is performed beforehand on a base paper having multiple print sides, and the base paper is cut into sheets of a predetermined size. If the booklet to be bound is a grid notebook, for example, grid scales can be printed continuously in a printing area in the middle of the sheet, that is on right and left pages (described later) including joint parts of the pages.

As the front cover 3 and the back cover 4, various types of conventionally known paper normally used for a perfect-bound booklet may be used. Specifically, a coated printing paper such as an art paper, a coat paper, and a lightweight coat paper; and a special paper such as a colored high quality paper, etc. may be used. The basis weight of the front cover 3 and the back cover 4 is not particularly limited, and a sheet within the range of 80 to 300 g/m2 may be used, for example. Both of the front cover 3 and the back cover 4 are trimmed (finished) in a final step of binding, where margins in the end edges at the top, bottom, and edge of a booklet 1 are cut off. Hence, the front cover 3 and the back cover 4 are formed slightly larger than the booklet 1 to be bound.

(1) Paper Folding Step

In the paper folding step, each of the sheets slightly larger than twice the area of the finishing size of the booklet to be bound is folded into two, to form multiple signatures. Since the sheet is trimmed in the end to cut off the top, bottom, and edge margins, the size of the sheet is set slightly larger than twice the area of the finishing size. This step may be performed in some other place, and a bundle 2 of multiple signatures may be brought in.

(2) Pressing Step

At the time when the bundle of signatures is brought in after the paper folding step, the bundle is higher (thicker) on the crease side and lower (thinner) on the booklet edge side, so that an upper end face of the bundle is tilted downward in a direction perpendicular to the crease. For this reason, in the pressing step, the creased part of the bundle of multiple signatures (the number of sheets is adjusted if necessary) is pressed in the thickness direction thereof. FIG. 1 shows an example of the pressing step. As shown in FIG. 1, pressing means 10, 11 are placed on a part of the bundle of signatures where the creases are thick, so as to sandwich the part in the thickness direction thereof. Thus, the creased part of the bundle of signatures is pressed. The pressure applied at this time is not particularly limited, as long as it is not less than 1.5 tons and within a normal range (up to around five tons). It is important that the creased part of the bundle of signatures be pressed in the pressing step to make the height of the bundle of signatures substantially the same on the creased side and the edge side. Undergoing the pressing step is extremely important for cutting one leaf neatly from an arbitrary page of a bound booklet.

(3) Paper Jogging Step

Figure 2:
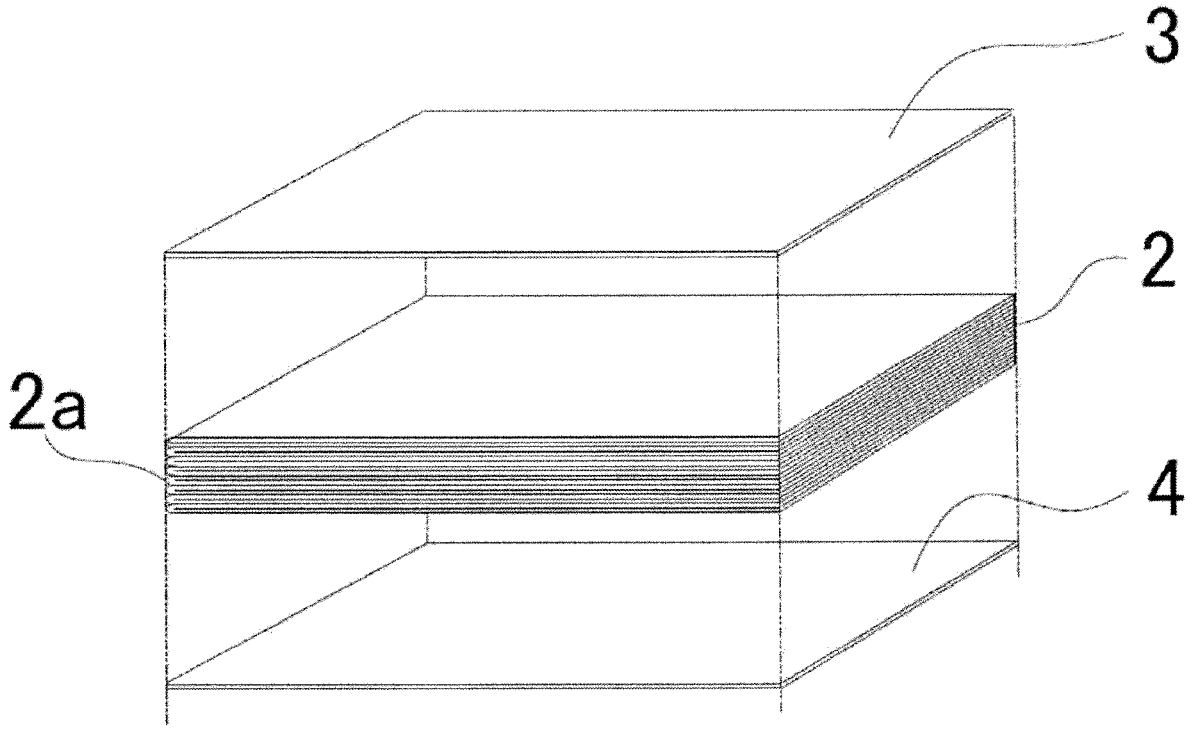
FIG. 2 is a diagram showing an example of a paper jogging step, where a one-book bundle is sandwiched by a front cover and a back cover in the paper jogging step after FIG. 1.
Figure 3:
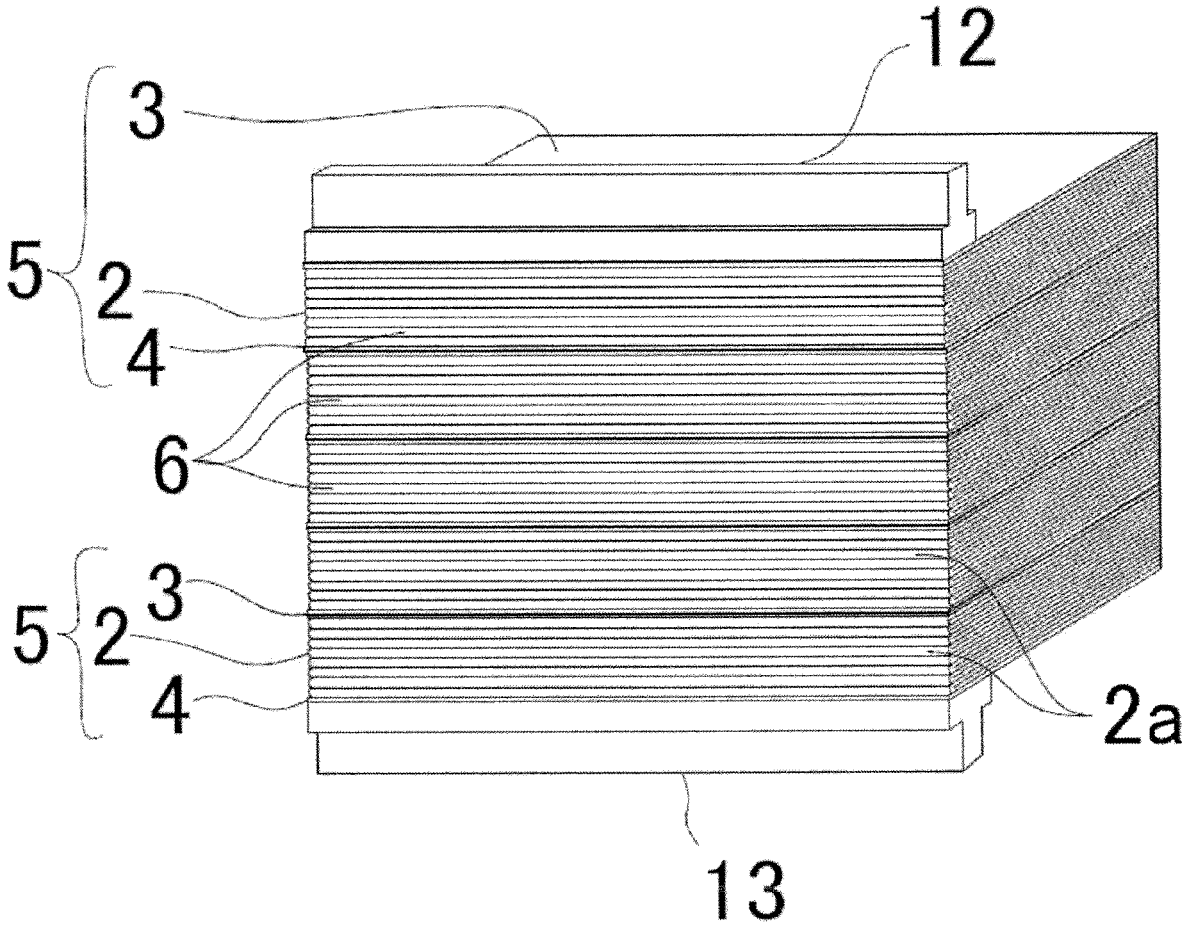
FIG. 3 is a diagram showing an example of a paper jogging step, where multiple one-book bundles shown in FIG. 2 are stacked on top of one another to jog a multi-book bundle.
Figure 4:
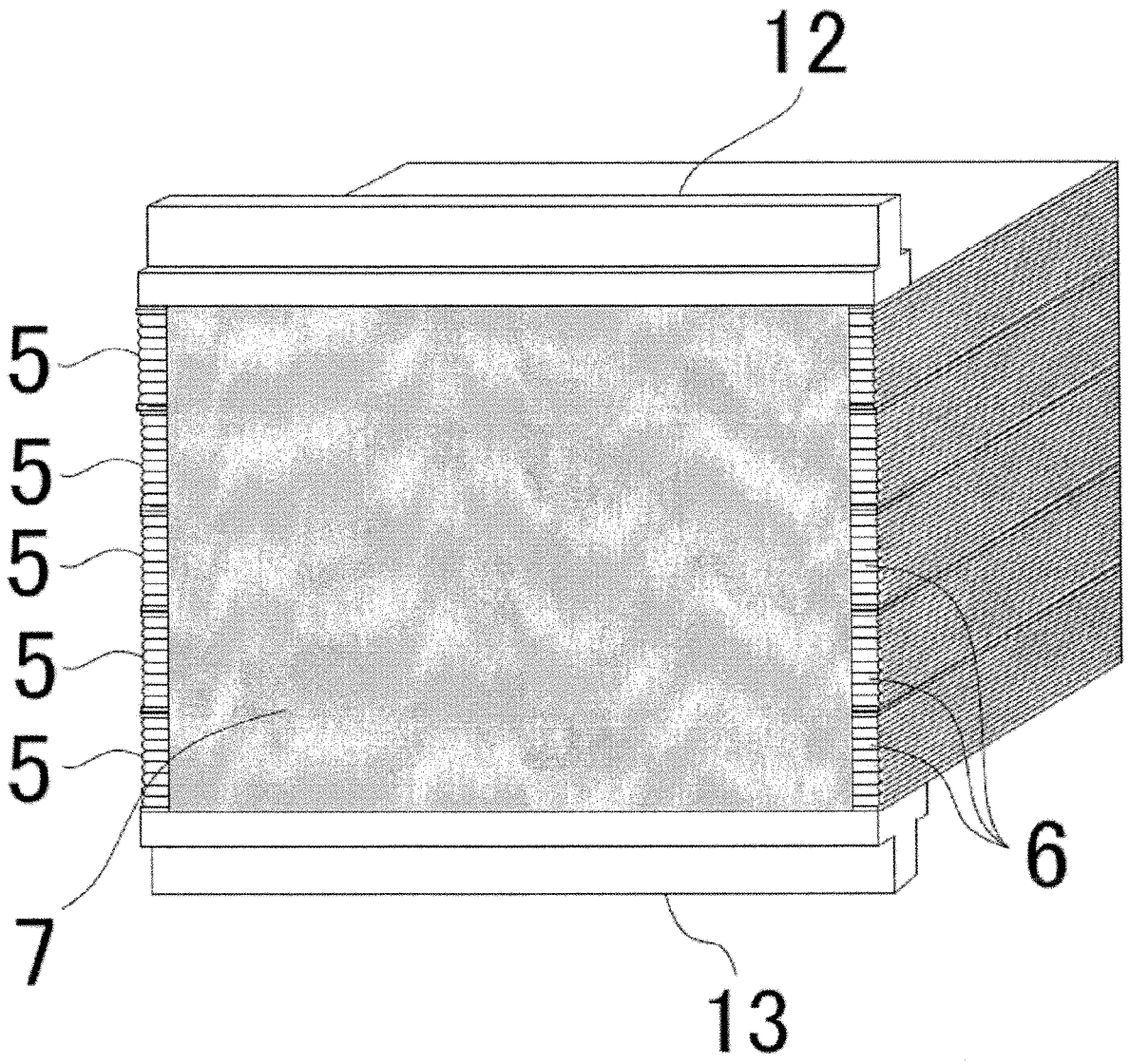
FIG. 4 is a diagram showing an example of a first application step following FIG. 3.

Next, as shown in FIG. 2, a one-book bundle 5 is formed by sandwiching the bundle 2 of a predetermined number of signatures obtained in the paper folding step, with the front cover 3 and the back cover 4. At this time, if the binding target is a notebook, the signatures have the same content printed thereon. Hence, the number of signatures refers to the number of signatures taken out of the bundle of multiple signatures. Meanwhile, if the binding target is a book such as a pocket book, the signatures are sorted into a predetermined editing order and piled by collation of book building (either manual or mechanical). Hence, the number of signatures refers to the number of signatures obtained as a result of the collation. Note that FIG. 2 only shows an arbitrary number of signatures included in the bundle 2, and the number is not particularly limited to this.

(4) First Application Step

A one-book bundle or a multi-book bundle 5, 5, 5, . . . in which multiple one-book bundles are stacked on top of one another are pressed in the thickness direction thereof by pressing means 12, 13, while a first adhesive 7 is applied (see FIG. 4) on a substantially rectangular middle area excluding each part of about 5 to 10 millimeters width from both top and bottom end edges of a rear face 6 of the multi-book bundle 5, 5, 5, . . . . At this time, as the first adhesive 7, a cold glue adhesive that remains flexible upon curing, and in particular, an acrylic copolymer emulsion adhesive (acrylic resin emulsion adhesive) in which an acrylic copolymer (60 to 70 mass percent of resin component (non-volatile matter) to the present total amount of adhesive) as a main component is suspended in water, may be used suitably. Note that the adhesive may include a minute quantity of methyl methacrylate, vinyl acetate, and the like.

A specific example of the adhesive is MB adhesive 22-686 (made by Matsumoto Hisao Shoten, K.K.). This adhesive should be used without diluting as it is while purchased. In this respect, the adhesive is easy to apply to the rear face 6 and is characterized in that it remains flexible upon curing and has high adhesiveness. Although the viscosity of the first adhesive 7 varies largely depending on its composition and use conditions, in terms of nominal viscosity (25° C.) included in the catalog, technical data, and the like presented by the manufacturer of the adhesive, for example, about 13000 mPa·s may serve as an index of the viscosity. Note that other than this adhesive, any adhesive that has substantially the same flexibility and adhesiveness may be used without being limited to the acrylic resin emulsion adhesive, and may be used with no particular limitation, for the binding method of the present invention.

The application method of the first adhesive 7 is not particularly limited, and conventionally known methods such as roller application, brush application, or the like may be adopted. Moreover, a coating method using various types of conventionally known coating machines such as a roll coater and a bar coater may be used. The amount and thickness of application of the first adhesive 7 are not particularly limited, as long as the adhesive is applied in a layer having as less unevenness as possible on the rear face 6 of the multi-book bundle when viewed. As a general guide, the application amount is preferably set to a range of about 200 to 550 grams per square meter, more preferably 300 to 500 grams, and yet more preferably 350 to 450 grams.

With the first adhesive 7 applied to the rear face of the multi-book bundle, the first adhesive 7 is dried and cured for about 0.5 to 2.5 hours, and preferably for 1 to 2 hours. The drying time of the first adhesive 7 may be appropriately set within the above range, by taking into account the work efficiency. In this case, although a reinforcement member such as a nonwoven fabric, a super, and tissue paper does not necessarily have to be laid over the entire face of the adhesive layer, one of these reinforcement members may be laid thereon. Additionally, although conventionally known equipment such as a dryer may be used for drying, just quietly placing the bundle indoors is enough. By drying the bundle for the aforementioned time in this state, the surface of the adhesive 7 is cured to such an extent that the adhesive 7 does not stick to the finger when touched.

Note that the first adhesive 7 may be applied twice as an undercoat and an overcoat in the aforementioned rectangular middle area. In this case, after applying the undercoat, when the surface cures as mentioned earlier, next, an overcoat should preferably be applied as a layer on the entire face of the undercoat so as to cover the undercoat. The drying time of the overcoat may be set for about the same time as the undercoat. In a case of using the reinforcement member mentioned earlier, the reinforcement member may be laid on the surface of the undercoat after application thereof, before applying the overcoat. The same or different material may be used as the undercoat and the overcoat. Although conventionally known equipment such as a dryer may be used for drying, the bundle may be dried by just quietly placing it indoors.

(5) Second Application Step

Figure 5:
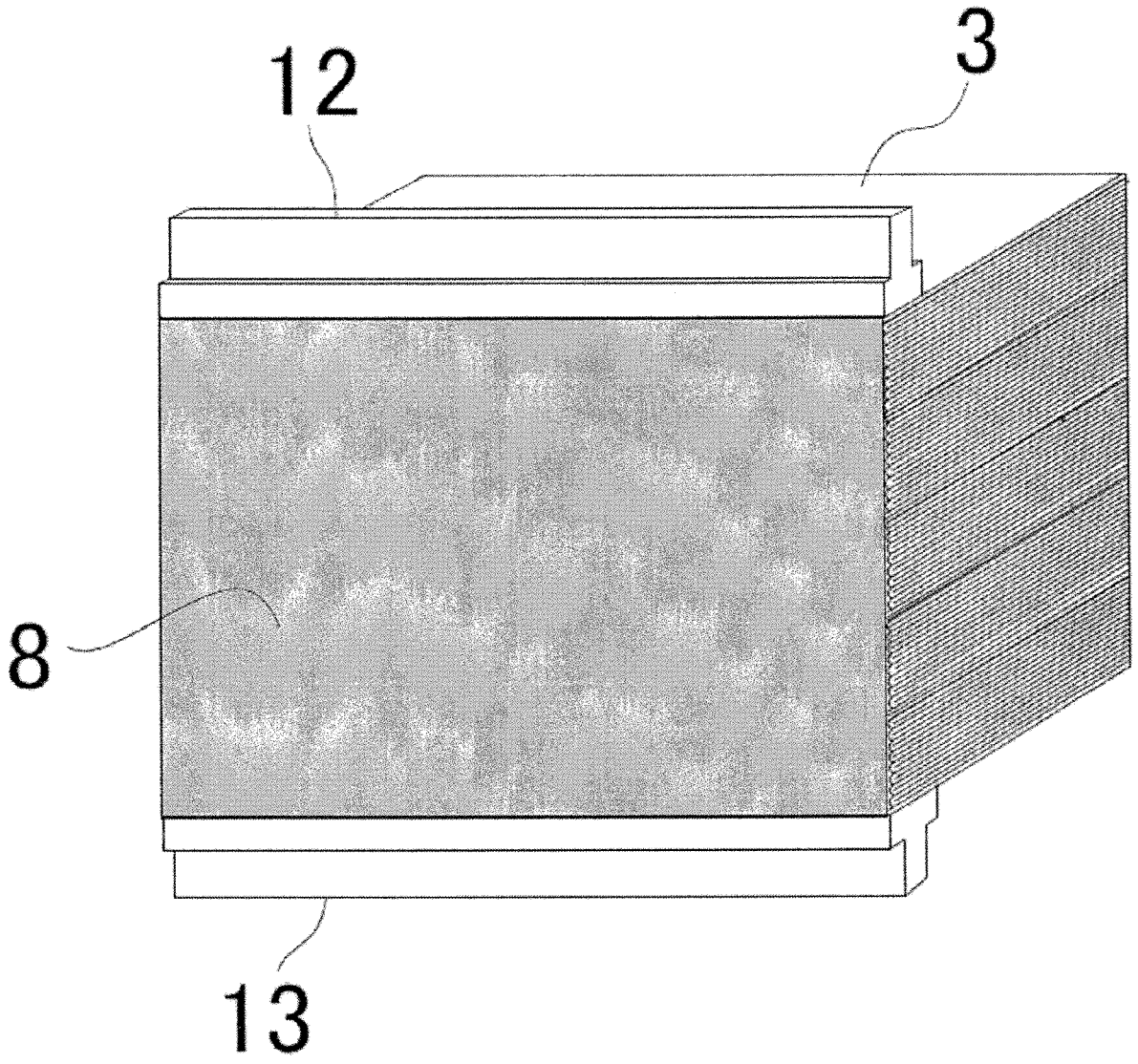
FIG. 5 is a diagram showing an example of a second application step following FIG. 4.

Next, as shown in FIG. 5, a second adhesive 8 is applied on the entire rear face 6 of the multi-book bundle pressed by the pressing means 12, 13 including the application face of the first adhesive 7. Various types of conventionally known adhesives may be used as the second adhesive 8 without particular limitation, as long as it is an adhesive that presents high adhesiveness by its curing. Examples of the second adhesive 8 include copolymer resin emulsion systems such as vinyl acetate resin emulsion adhesives, ethylene-vinyl acetate resin emulsion adhesives, acrylic resin emulsion adhesives and so on, and adhesives containing a copolymer of these components. These adhesives preferably contain 40 to 65 mass percent, more preferably 45 to 60 mass percent, and yet more preferably 45 to 55 mass percent of non-volatile matter to the present total amount of the adhesive.

If the second adhesive 8 is within such range of volatile matter, the adhesiveness improves initially and after its curing, whereby a high adhesiveness between the first adhesive layer and the top and bottom end areas of the rear face 6 of the multibook bundle 5, 5, 5, . . . can be achieved.

Of these adhesives, water-based emulsion adhesives containing an ethylene-vinyl acetate copolymer or a vinyl acetate acrylic copolymer as a main component, emulsion adhesives in which the two copolymers coexist, for example, are particularly preferably used. As an example of the latter adhesive, MB adhesive 7K-M (made by Matsumoto Hisao Shoten, K.K.), for example, is particularly favorably used. According to the product safety data sheet of the adhesive, this adhesive contains an ethylene-vinyl acetate copolymer and a vinyl acetate-acrylic copolymer by 53.0 mass percent. These and isopropyl alcohol (0.2 mass percent content) and vinyl acetate (0.3 mass percent content) as minor components are suspended in water (46.5 mass percent content) (all of the contents are indicated relative to the overall adhesive amount as 100 mass percent). This adhesive should be used without diluting as it is while purchased, and in this respect, is easy to apply to the rear face 6 and is characterized in its high adhesiveness after its curing.

The viscosity of the second adhesive 8 varies largely depending on its composition and use conditions. For example, in the case of the exemplified adhesives, according to the catalogue, technical data, and the like presented by the manufacturer, the nominal viscosity (30° C.) is 8000 mPa·s. Accordingly, this nominal viscosity may serve as a general guide for the viscosity of the second adhesive 8.

The application method of the second adhesive 8 is not particularly limited, and as in the case of the first adhesive 7, other than conventionally known methods such as roller application, brush application, or the like, a coating method using various types of conventionally known coating machines such as a roll coater and a bar coater may be used. In addition to the application face of the first adhesive 7, the second adhesive 8 is applied over the entire face of the rear face 6 of the multi-book bundle 5, 5, . . . , including the area of 5 to 10 millimeters width from both top and bottom ends where the first adhesive 7 is not applied. In this case, as for the area where the first adhesive 7 is not applied, it is important that the thickness of the second adhesive 8 be increased, so that the thickness is substantially the same as the total thickness of the application face of the first adhesive 7 and the overcoat applied thereon.

The amount of application of the second adhesive 8 is not particularly limited, as long as the adhesive is applied as a layer whose thickness over the entire rear face 6 of the multi-book bundle is as even as possible when viewed. As a general guide, the application amount is preferably set to a range of about 200 to 450 grams per square meter, more preferably 220 to 400 grams, and yet more preferably 240 to 350 grams.

Then, the second adhesive 8 is dried and cured. The drying time may be appropriately set by taking into account the convenience and efficiency of work, and may be generally set to about 1 to 3 hours (preferably 1 to 2.5 hours) or more. Hence, if it is preferable to leave the adhesive as it is all day and night from the viewpoint of work efficiency, this is acceptable. As in the case of the first adhesive 7, conventionally known equipment such as a dryer may be used for drying, or the bundle may just be quietly placed indoors. By drying the bundle for the aforementioned time in this state, the surface of the adhesive 8 is cured to be sufficiently hard when touched by a finger. After the elapse of a predetermined drying time of the second adhesive 8, each of the one-book bundles 5 is cut off from the multi-book bundle 5, 5, 5, . . . .

Figure 6:
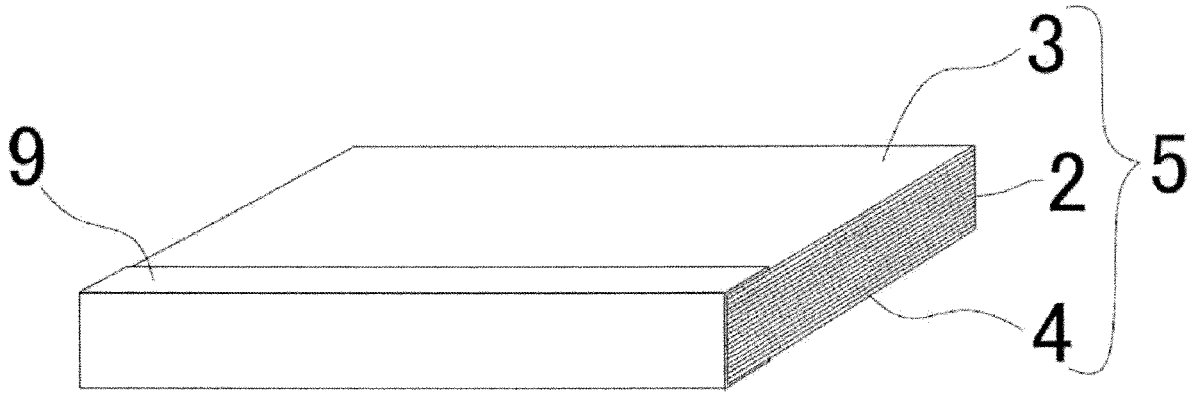
FIG. 6 is a perspective view of a clothbound perfect-bound booklet as an example of a booklet bound by the binding method of a perfect-bound booklet of the present invention.

While the cut one-book bundle 5 may be subjected to trimming to complete the binding of the perfect-bound booklet, trimming may be done after a strip-shaped binding cloth is attached on the rear face of the one-book bundle 5, so as to cover the outer face of a joint part between the rear face of the one-book bundle 5 and the front cover 3 and the back cover 4. Thus, binding of a clothbound perfect-bound booklet 1 is completed as shown in FIG. 6.

As has been described, the binding method of a perfect-bound booklet of the present invention includes the following three configurations.

(1) In each signature forming the body 2, the crease formed in the paper folding step is pressed even stronger in the pressing step.

(2) The first adhesive that remains flexible upon curing is applied to the middle area exclusive of both the top and bottom end areas of the rear face of the one-book bundle.

(3) Before the first adhesive layer dries and cures sufficiently, the second adhesive that has high adhesiveness is applied to the first adhesive layer and the top and bottom end areas of the rear face of the one-book bundle. Thus, the binding method of the present invention achieves binding of a perfect-bound booklet having the excellent characteristics described below.

The binding method of a perfect-bound booklet of the present invention is applicable to the binding of various perfect-bound booklets such as books like a pocket book, and a notebook, for example. In particular, the binding method is effectively applicable to binding of booklets such as a notebook having about 30 to 300 pages.

Note that although an embodiment of the binding method of a perfect-bound booklet of the present invention has been described by using a clothbound perfect-bound booklet as an example, the invention is not limited to binding of such a clothbound booklet. For example, the invention is applicable to case binding in which a glued-on cover including a front cover and a back cover is used to wrap the body. In this case, first, a glued-on cover is formed by integrally forming a front cover and a back cover arranged on both sides of a strip-shaped part corresponding to a spine part. In addition, stripes are formed so as to separate the front cover and back cover from the spin label. Then, the spine part of the glued-on cover is glued to a rear face of the body to perform case binding. For example, the body can be wrapped with the glued-on cover immediately after applying the second adhesive 8 on the rear face of the body, so that the glued-on cover and the body are bonded by curing of the second adhesive 8.

[Perfect-Bound Booklet]

Figure 7:
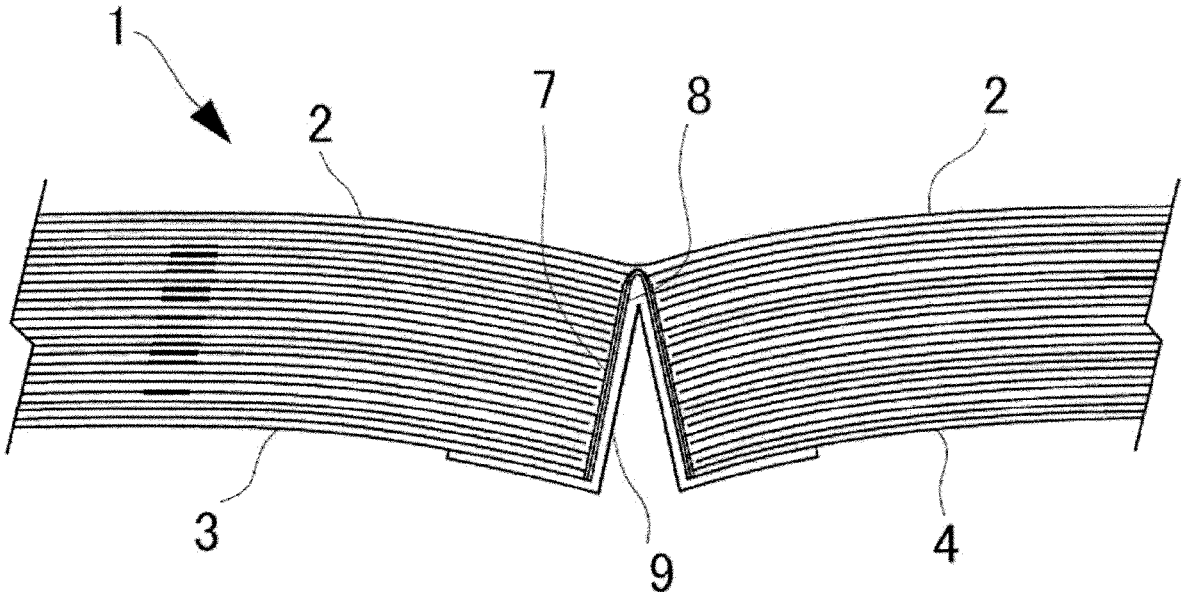
FIG. 7 is a cross-sectional view of an open state of the perfect-bound booklet shown in FIG. 6.

Next, an embodiment of a perfect-bound booklet of the present invention will be described with reference to FIGS. 6 and 7. FIG. 6 shows a perspective view of a clothbound perfect-bound booklet as an example bound by the aforementioned binding method of a perfect-bound booklet of the present invention, and FIG. 7 shows a cross-sectional view of an open state of the clothbound booklet shown in FIG. 6. Note that in FIG. 7, parts common to FIGS. 1 to 6 are assigned the same reference numerals, and overlapping descriptions will be omitted.

As shown in FIG. 6, a perfect-bound booklet 1 obtained by the binding method of the present invention includes a body 2 in which a predetermined number of sheets are stacked on top of one another, a front cover 3, a back cover 4, a first adhesive layer 7 applied on a rear face of a one-book bundle 5 bundling the body 2, the front cover 3, and the back cover 4, a second adhesive layer 8 applied and cured on the first adhesive layer 7, and a binding cloth 9 attached on the second adhesive layer 8 and an outer face of a joint between the front cover and the back cover.

It is inferred that the perfect-bound booklet 1 of the present invention has a higher flexibility (elasticity) of the adhesive layer 7 by using the first adhesive 7 whereby freedom in the movement of a leaf in an arbitrary signature forming the body 2 has increased. Additionally, since the second adhesive layer 8 having high adhesiveness is provided to cover the first adhesive layer 7, when the booklet (body) is opened at an arbitrary page, the adhesive layers (7, 8) are forcibly bent as shown in FIG. 7. With this, the leaves (signatures) of right and left pages fixed substantially perpendicularly to the adhesive layers (7, 8) collapse horizontally, and since due to the increased freedom of movement, the leaves separate from each other to open 180 degrees. As a result, excellent spreadability is achieved.

Moreover, the first adhesive layer 7 is provided only in the middle area of the rear face of the one-book bundle 2 and only the second adhesive layer 8 is placed in both the top and bottom end areas of the rear face. Hence, in an arbitrary signature, only the top or bottom end part comes off more easily from the second adhesive layer 8, and a slit is more easily formed, as compared to the middle area. What is more, in each signature, the crease is pressed even harder in the pressing step, whereby the leaf can be cut off neatly along the crease from the aforementioned slit.

Since the perfect-bound booklet bound by the binding method of the present invention thus achieves spreadability of substantially 180 degrees, when the body is opened at an arbitrary page, a printing area that continues over the left page and the right page including the joint can be formed. Grid scales may be printed in the printing area, for example. A booklet with such grid scales printed thereon is advantageous in that data can be plotted over a longer period of time than in a conventional booklet with grid scales printed page by page. Additionally, since the perfect-bound booklet of the present invention has excellent spreadability, when copying an arbitrary spread-page, a clear copy can be obtained without causing smudges in the joint part as in a conventional perfect-bound booklet.

Example

A notebook which is a perfect-bound booklet of the present invention was produced as shown in FIG. 1. The size of the notebook is B5. The body was formed of 30 pages by bundling signatures obtained by folding 15 high-quality papers (70 g/m2 basis weight) slightly larger than size B4. Each signature has 1 mm grid scales printed thereon in a middle area including a crease, so that the grid scales are symmetrical with respect to the crease. A margin between the printed part and three sides except for the crease is set to about 20 mm in each signature. Additionally, a high quality paper having a basis weight of 100 g/m2 was used as the front cover and back cover. Each of the body, the front cover, and the back cover is slightly larger than size B5, to be trimmed (finished) in the end.

A one-book bundle was created by sandwiching the body with the front cover and the back cover, 100 one-book bundles were stacked on top of one another (multi-book bundle), and creased parts at the back of the multi-book bundle were pressed (1.5 ton pressure) by press means in the thickness direction of the bundle. After releasing the press and sandwiching and fixing the multi-book bundle with pressure, the first adhesive was undercoated in a layer in the middle area which is 5 millimeters from the top and bottom end edges on the rear face of the multi-book bundle. As the first adhesive, product name: MB adhesive 22-686 (acrylic copolymer emulsion adhesive) made by Matsumoto Hisao Shoten, K.K. was used as it is (undiluted form). The first adhesive was applied for 34 grams on an application face formed by stacking 100 notebooks (3 mm thickness, 280 mm height per notebook), and therefore, the calculated application amount of the first adhesive was 0.34 grams per booklet, and 405 g/m2 per square meter. The drying time of the first adhesive was 1.5 hours.

After the elapse of the aforementioned drying time, and checking that the adhesive does not attach on the finger when the surface of the adhesive layer is touched, the second adhesive was applied on the entire face of the rear face of the multi-book bundle. The used second adhesive was product name: MB adhesive 7K-M (vinyl acetate acrylic copolymer, ethylene-vinyl acetate copolymer water-based emulsion adhesive) made by Matsumoto Hisao Shoten, K.K., and was used as it is (undiluted form). Moreover, the second adhesive was applied thickly in parts of the rear face of the multi-book bundle in both the top and bottom end areas where the first adhesive is not applied, so as to form substantially the same total thickness as the middle area to which the first adhesive is applied. The second adhesive was applied for 23 grams on an application face formed by stacking 100 notebooks (3 mm thickness, 280 mm height per notebook), and therefore, the calculated application amount of the second adhesive was 0.23 grams per booklet, and 274 g/m2 per square meter. Then, the multi-book bundle was left for a whole day and night to dry and cure the second adhesive. Thereafter, each one-book bundle was cut off, a binding cloth was attached on the rear face of each bundle, and each bundle was trimmed to complete binding of a clothbound size B5 perfect-bound notebook.

When an arbitrary page of the body of the thus-obtained notebook was opened, both of the right and left pages opened substantially 180 degrees, and excellent spreadability was confirmed. Additionally, arbitrary 10 booklets were taken out from the 100 booklets, and an end part on the edge side of one sheet of each body was held with fingers and vertically shaken 20 times. However, no signature came off or dropped. Hence, it was assumed that the sheets forming the body of the 10 taken out notebooks were sufficiently bonded to the back of the notebook. Of these 10 booklets, an arbitrary page was opened for each booklet, and the top end part of one of the spread pages was pressed with a finger, while the leaf on the other page was cut off along the crease. Consequently, the leaf was cut off neatly along the crease in every notebook.

REFERENCE SIGNS LIST

1 perfect-bound booklet
2 body
2*a* rear face
3 front cover
4 back cover
5 one-book bundle
6 rear face
7 first adhesive application (undercoat) layer
8 second adhesive application (overcoat) layer
9 cloth
10, 11 press means
12, 13 pressing means
P pressure

The invention claimed is:

1. A binding method of a perfect-bound booklet comprising:

a paper folding step of folding each leaf of sheets forming a body to obtain multiple signatures;

a pressing step of pressing creased parts of the multiple signatures in a thickness direction of the multiple signatures;

a paper jogging step of jogging a one-book bundle formed of a predetermined number of signatures forming a body, a front cover, and a back cover, or a multi-book bundle formed by stacking a plurality of one-book bundles on top of one another;

a first application step of applying a first adhesive that remains flexible upon curing, in a layer in a middle area 5 to 10 millimeters width from both top and bottom end edges of a rear face of the one-book bundle or the multi-book bundle; and a second application step of applying a second adhesive in a layer on an entire rear face of the one-book or multi-book bundle including the parts where the first adhesive is not applied, after leaving the first adhesive layer for a predetermined drying time.

2. The binding method of a perfect-bound booklet according to claim 1, wherein the first adhesive is an acrylic resin emulsion adhesive.

3. The binding method of a perfect-bound booklet according to claim 2, wherein the drying time of the first adhesive is set within a range of 0.5 to 2.5 hours.

4. A perfect-bound booklet bound by use of the binding method of a perfect-bound booklet according to claim 2, wherein when a body is opened at an arbitrary page, a printing area continuous from a left page to a right page is formed.

5. The binding method of a perfect-bound booklet according to claim 1, wherein the drying time of the first adhesive is set within a range of 0.5 to 2.5 hours.

6. The binding method of a perfect-bound booklet according to claim 1, wherein the second adhesive is a water-based emulsion adhesive containing an ethylene-vinyl acetate copolymer or a vinyl acetate acrylic copolymer as a main component.

7. The binding method of a perfect-bound booklet according to claim 6, wherein the drying time of the second adhesive is set to 1 to 3 hours or more.

8. A perfect-bound booklet bound by use of the binding method of a perfect-bound booklet according to claim 6, wherein when a body is opened at an arbitrary page, a printing area continuous from a left page to a right page is formed.

9. The binding method of a perfect-bound booklet according to claim 1, wherein the drying time of the second adhesive is set to 1 to 3 hours or more.

10. The binding method of a perfect-bound booklet according to claim 1 further comprising a cloth bonding step of placing and attaching a strip-shaped binding cloth on a rear face of a one-book bundle having undergone the step of drying the second adhesive.

11. A perfect-bound booklet bound by use of the binding method of a perfect-bound booklet according to claim 10, wherein when a body is opened at an arbitrary page, a printing area continuous from a left page to a right page is formed.

12. The binding method of a perfect-bound booklet according to claim 1 comprising a wrapping step of wrapping the body with the front cover and the back cover formed integrally so as to sandwich a rear part.

13. A perfect-bound booklet bound by use of the binding method of a perfect-bound booklet according to claim 12, wherein when a body is opened at an arbitrary page, a printing area continuous from a left page to a right page is formed.

14. A perfect-bound booklet bound by use of the binding method of a perfect-bound booklet according to claim 1, wherein when a body is opened at an arbitrary page, a printing area continuous from a left page to a right page is formed.

* * * * *